US006984291B2

(12) United States Patent
Pitt

(10) Patent No.: US 6,984,291 B2
(45) **Date of Patent: *Jan. 10, 2006**

(54) VACUUM BOX WITH SKIMMER BLADE

(75) Inventor: Richard E. Pitt, Almonte (CA)

(73) Assignee: AstenJohnson, Inc., Charleston, SC (US)

( * ) Notice: Subject to any disclaimer, the term of this patent is extended or adjusted under 35 U.S.C. 154(b) by 43 days.

This patent is subject to a terminal disclaimer.

(21) Appl. No.: 10/450,243

(22) PCT Filed: Dec. 14, 2001

(86) PCT No.: PCT/CA01/01804

§ 371 (c)(1),
(2), (4) Date: Oct. 20, 2003

(87) PCT Pub. No.: WO02/48455

PCT Pub. Date: Jun. 20, 2002

(65) Prior Publication Data

US 2004/0099394 A1 May 27, 2004

(30) Foreign Application Priority Data

Dec. 15, 2000 (GB) ..... 0030682

(51) Int. Cl.
*D21F 1/00* (2006.01)

(52) U.S. Cl. ..... 162/300; 162/352; 162/363; 162/374; 162/351

(58) Field of Classification Search ..... 162/300, 162/352, 363, 374, 351

See application file for complete search history.

(56) References Cited

U.S. PATENT DOCUMENTS

| | | | |
|---|---|---|---|
| 4,865,692 | A | 9/1989 | Kade et al. |
| 4,875,977 | A | 10/1989 | Creagan et al. |
| 5,167,770 | A | 12/1992 | Bubik et al. |
| 5,202,000 | A | 4/1993 | Phillips |
| 5,215,628 | A | 6/1993 | Koivuranta et al. |

(Continued)

FOREIGN PATENT DOCUMENTS

| | | |
|---|---|---|
| CA | 1240187 | 8/1988 |

(Continued)

*Primary Examiner*—Mark Halpern
(74) *Attorney, Agent, or Firm*—Shapiro Cohen

(57) ABSTRACT

A process, and an apparatus, for improving sheet properties in a twin fabric paper making machine forming section whereby pressure pulse generation in the stock can be controlled. The pressure pulses are controlled by mounting a vacuum assisted skimmer blade (15) supported by an adjustable resilient support means (18) so that its height can be altered, and so that it can respond to transient changes in the stock layer thickness. The resilient and adjustable support means (18) itself is supported by a vacuum drainage box (10), which serves to capture at least the major proportion of the fluid skimmed of by the skimmer blade (15). This apparatus the position of the skimmer blade (15) to be altered in two ways without stopping the paper making machine. The skimmer blade (15) can be located either so that it is out of contact with the forming fabric (3), or so that it can be in contact with the forming fabric. By adjusting the resilient adjustable mounting, the amount of pressure exerted by the skimmer blade (15) onto the forming fabric surface is controllable, thus controlling the pressure pulses generated by the skimmer blade. The orientation of the skimmer blade can also be controlled, so that rather than the blade surface being substantially parallel to the machine side surface of the forming fabric, it can be angled somewhat with either its leading or its trailing edge pressed into the fabric.

11 Claims, 1 Drawing Sheet

U.S. PATENT DOCUMENTS

| | | | |
|---|---|---|---|
| 5,262,010 | A | 11/1993 | Bubik et al. |
| 5,354,426 | A | 10/1994 | Rucker |
| 5,427,654 | A | 6/1995 | Gray et al. |
| 5,507,918 | A | 4/1996 | Polifke et al. |
| 5,573,643 | A | 11/1996 | Jaakkola et al. |

FOREIGN PATENT DOCUMENTS

| | | |
|---|---|---|
| CA | 2050647 | 3/1992 |
| DE | 40 28 126 | 3/1992 |
| EP | 0 318 107 | 11/1988 |
| EP | 0 373 133 | 11/1989 |
| EP | 0 393 656 | 4/1990 |
| EP | 0 520 970 | 12/1992 |
| EP | 0 900 877 | 3/1999 |
| WO | WO 92 04500 | 3/1992 |
| WO | WO 93 12292 | 6/1993 |
| WO | WO 98 44193 | 10/1998 |

VACUUM BOX WITH SKIMMER BLADE

CROSS-REFERENCE TO RELATED APPLICATIONS

This application is related to application Ser. No. 10/450,244, assigned to the assignee of this application.

This application is a 371 of PCT/CA01/01804 filed on 14 Dec. 2001.

FIELD OF THE INVENTION

The present invention relates to a process, and an apparatus, for removing fluid from the machine side of one, or both, forming fabrics in the forming section of a twin forming fabric paper making machine. It is particularly concerned with a process and an apparatus to remove and capture a major proportion of the fluid drained through a forming fabric, by contacting the machine side of one of the forming fabrics with at least one resiliently mounted skimmer blade located between two fixed blades in contact with the machine side of the other forming fabric, for example between two blades supported by a forming shoe. The, or each, resilient mounting is attached to a vacuum box, with the skimmer blade located immediately downstream of an elongate suction orifice. This invention is thus of use in any twin fabric papermaking machine having two superposed forming fabrics, particularly those equipped with a curved forming shoe.

BACKGROUND OF THE INVENTION

In the manufacture of paper and board products in a twin fabric paper making machine, a highly aqueous stock consisting of about 98–99.8% water and from 0.2–2% papermaking fibers and other solids is ejected at high speed from a headbox slice into the gap between the moving forming fabrics. In the following discussion, for the sake of simplicity, it is assumed that the path followed by the twin forming fabrics is more or less horizontal; other arrangements are known and used in which the path is not horizontal and may even be vertical. In such machines a direction substantially perpendicular to the two forming fabrics is known as the Z-direction. Further, when the path is horizontal, one forming fabric is commonly referred to as the "upper", and the other as the "lower" fabric.

In a twin fabric forming section, the two forming fabrics each pass in sliding contact over a plurality of fabric support elements which serve to define a path along which the two forming fabrics move together; these elements, together with their supporting structures, are generally known as forming shoes and the forming fabric path over them may be straight or curved. The stationary fabric support elements in contact with the machine side of the lower forming fabric may be fixed, or may be adjustable in the Z-direction. In current practice, the stationary support elements in contact with the machine side of the upper fabric are normally not adjustable, while those in contact with the machine side of the lower forming fabric can be resiliently mounted so as to assist with fluid removal. The resiliently mounted blades are not used in association with a vacuum box, and rely on gravity to assist with fluid drainage. Further, the fabric support elements in contact with each fabric are known to generate pressure pulses within the stock between the two forming fabrics as they move together under tension through the forming section. The nature of the pressure pulses generated in the stock can only be adjusted by changing fabric tension, by changing the angles of wrap of the fabrics over the fabric contacting surfaces of a chosen element or elements, by changing a chosen element or elements, or by physically removing an element or elements. Pressure pulsed benefit the forming process by causing relative motion in the stock layer that breaks apart the fibre flocs and causes the fibers to become more uniformly dispersed in the stock layer.

Fixed elements are unable to react to transient changes in the thickness of the stock layer between the forming fabrics. Such changes can occur when the machine is being started, and also may occur at any time during normal machine operation. In an extreme case, transient stock thickness variation can result in damage to either, or both, of the forming fabrics.

This invention seeks to provide a process, and an apparatus, by means of which the papermaker can control both fluid removal from the machine side surface of at least one of the forming fabrics, and pulse formation in the stock between the two forming fabrics so as to enhance, maintain or diminish the kinetic energy injected into the stock, thus allowing optimized fluid removal and agitation in accordance with paper making conditions. This invention further seeks to provide an apparatus in which a skimmer blade is resiliently mounted, so that the mounting allows the skimmer blade to respond to transient changes in the thickness of the stock layer between the two moving forming fabrics. The invention further seeks to provide an apparatus including a skimmer blade which is resiliently mounted and located immediately downstream of an elongate suction orifice attached to a vacuum box, wherein the resilient mounting is attached to the vacuum box, and the vacuum box as a unit can be moved away from the path of the forming fabrics as they move through the forming section.

DISCUSSION OF THE PRIOR ART

Kade et al, in U.S. Pat. No. 4,865,692, disclose an adjustable support structure for a foil blade, for use in a conventional single fabric open surface forming section, which allows the orientation of the blade relative to the forming fabric to be adjusted. In this structure, two C-section beams are interlocked to provide an essentially S-shaped structure. The upper C-beam carries the foil blade, and the lower C-beam is mounted onto a drainage box. However, this structure only allows a small angular change and the axis about which the angle changes is not defined with any precision.

Skyttä in EP 0 319 107 discloses a twin fabric forming section in which "deck elements" are located opposite fixed elements. Although the deck elements are rigidly mounted as a group onto either a suction box, or a drainage box, the deck elements are given some resiliency by providing a resilient mounting for the supporting box. There is no disclosure of providing a resilient mounting for each individual blade, and the deck element assembly as a unit cannot be moved out of contact with the adjacent forming fabric.

Hujala in EP 0373 133 discloses an improvement to the known "Sym-Former R" hybrid forming section. To assist in upward dewatering of the upper forming fabric, a rigidly mounted suction-aided doctoring device is located within the loop of the upper forming fabric. The opening of the water receiving orifice is mechanically adjustable, by means of a spindle mechanism. The blades located beneath the lower forming fabric are resiliently mounted, and the pressure they exert on the lower fabric can be made to increase n the downstream direction.

Bubik et al. in U.S. Pat. No. 5,262,010 disclose a number of varied structures, again intended for use in a single fabric open surface paper making machine. These structures allow either a single foil, or a group of commonly mounted foils, to be moved into contact with the forming fabric. The stated aim is to stabilize the foil, or group of foils, to counteract the tilting forces produced by friction between the foil, or foils, and the moving forming fabric with which they are in sliding contact. Although pressurized hoses are used in many of the disclosed they all appear to involve parts which are in sliding contact with each other.

Bubik et al. in CA 2,050,647 (application as filed and published) also disclose a skimmer blade arrangement for use with the upper forming fabric of a twin fabric machine in which the forming section is essentially horizontal. As disclosed, a slot is use to trap fluid displaced from the stock upwardly through the upper forming fabric, which is doctored off the fabric by a skimmer blade. The skimmer blade appears to carried by an "elastic" mounting, but it is unclear how this mounting is constructed. There is no mention of the use of vacuum to trap the doctored off fluid.

SUMMARY OF THE INVENTION

This invention seeks to provide both a process, and an apparatus, to remove fluid from the machine side surface of at least one forming fabric the forming section of a twin fabric paper making machine. According to this invention, a resiliently mounted skimmer blade is placed to contact the machine side of one forming fabric at a point that is between two fixed support elements in contact with the machine side of the other forming fabric; these fixed support elements may form part of a forming shoe. The resiliently mounted skimmer blade is located immediately downstream of an elongate orifice in the cross machine direction, which is connected to a vacuum box. The level of vacuum in the vacuum box is controlled so that the fluid doctored of the forming fabric by the skimmer blade is captured in the elongate orifice, and transferred to the vacuum box. The fluid therefore cannot fall back onto the forming fabric and cause defects in the incipient paper web. The amount of pressure applied to the machine side surface of the forming fabric is adjustable, so that its indentation into the forming fabric, and hence the pressure pulses generated within the stock between the forming fabrics, can be controlled to optimize paper making conditions. The resilient mounting is conveniently attached to the vacuum box, which is adjustably mounted so that the skimmer blade can be moved away from the forming fabric, thus protecting it from major disturbances in stock thickness, such as at machine start up, by moving the entire assembly away from the machine side of the forming fabric.

In this invention, both fluid removal and the pressure pulses are controlled by mounting a vacuum assisted skimmer blade supported by an adjustable support means so that its position relative to the machine side of the adjacent forming fabric can be altered. Additionally, in this invention the ability to respond to transient changes in the stock layer thickness is provided by fabricating the skimmer blade mounting so that it is resilient, and allows a limited range of spontaneous movement in the Z-direction. Further, the resilient and adjustable support means itself is supported by a vacuum drainage box, which serves to capture at least the major proportion of the fluid skimmed off by the skimmer blade. The apparatus envisaged by this invention allows the position of the skimmer blade to be altered in two ways without stopping the paper making machine. First, by moving the vacuum assisted drainage box, the skimmer blade can be located either so that it is out of contact with the forming fabric, or so that it can be in contact with the forming fabric. Second, by adjusting the resilient adjustable mounting, the amount of pressure exerted by the skimmer blade onto the forming fabric surface is controllable, thus controlling the pressure pulses generated in the stock by the skimmer blade, and the quantity of fluid removed by the skimmer blade. Additionally, this invention contemplates that more than one adjustable skimmer blade, each mounted onto its own vacuum box as a skimmer blade assembly, can be used in a twin fabric forming section if desired. It is also contemplated that an adjustable skimmer blade assembly may be mounted on either side, or both sides, of the two forming fabrics in suitable locations. Furthermore, this invention also contemplates that the orientation of the skimmer blade can be controlled, so that rather than the blade surface being substantially parallel to the machine side surface of the forming fabric, it can be angled somewhat with either its leading or its trailing edge pressed into the fabric.

Thus in a first broad embodiment this invention seeks to provide a suction assisted fluid skimmer blade mounting for use in a twin fabric forming section of a paper making machine having a machine direction and a cross machine direction, and including in the forming section two opposed forming fabrics which move together in the machine direction, each fabric having a machine side surface and a paper side surface, the mounting including:

- a vacuum chamber, having an elongate orifice extending in the cross machine direction, to which a controlled vacuum means is connected;
- a first adjustable support means supporting the vacuum chamber;
- a second adjustable resilient support means carried by the vacuum chamber and adjacent the elongate orifice; and
- a skimmer blade attached to the second adjustable resilient support means, the skimmer blade having a fabric contacting surface extending in the cross machine direction including a leading and a trailing edge;

wherein:

(a) the first adjustable support means is constructed and arranged to allow the vacuum chamber to be positioned in a first position where the skimmer blade is out of contact with the first forming fabric, and a second position where the skimmer blade can be in contact with the forming fabric;

(b) the second adjustable resilient support means is constructed and arranged to allow movement of the skimmer blade when the vacuum chamber is in the second position to any point between a first locus where the fabric contacting surface of the skimmer blade is out of contact with the first forming fabric, and a second locus where the fabric contacting surface of the skimmer blade is pressed into the machine side surface of the first forming fabric;

(c) the vacuum chamber, together with the vacuum supply means, is constructed and arranged, when positioned in the second position, to capture into the elongate orifice at least a major proportion of any fluid skimmed off the first moving forming fabric adjacent the leading edge of the fabric contacting surface of the skimmer blade.

In a second broad embodiment this invention seeks to provide a process for improving sheet properties and fluid removal in a paper making machine forming section, having a machine direction and a cross machine direction, and including a first and a second opposed forming fabric, each of which has a machine side surface and a paper side surface, which move together in the machine direction, and a head box slice which delivers a stock jet into a gap between the paper side surfaces of the first and the second forming fabrics, comprising the steps of:

(i) discharging the stock jet into the gap between the paper side surfaces of the first and the second moving forming fabrics;

(ii) moving a resiliently mounted skimmer blade, having a leading edge and a trailing edge, into contact with the machine side surface of the first forming fabric;

(iii) adjusting at least one parameter chosen from the group consisting of the pressure pulses generated within the stock, and the amount of fluid skimmed from the machine side surface of the first forming fabric, by altering the position, or the orientation, or both the position and orientation, of the fabric contacting surface of the at least one resiliently mounted blade; and (iv) capturing at least a major proportion of any fluid skimmed off the machine side of the first forming fabric by means of a controlled level of vacuum applied to an elongate cross-machine direction orifice adjacent the leading edge of the skimmer blade.

In a third broad embodiment, this invention seeks to provide a forming section for a paper making machine including a first and a second opposed forming fabric, each fabric having a machine side surface and a paper side surface, including at least one suction assisted fluid skimmer blade carried by a mounting including:

a vacuum chamber, having an elongate orifice extending in the cross machine direction, to which a controlled vacuum means is connected;

a first adjustable support means supporting the vacuum, chamber;

a second adjustable resilient support means carried by the vacuum chamber and adjacent the first forming fabric; and a skimmer blade attached to the second adjustable resilient support means, the skimmer blade having a fabric contacting surface extending in the cross machine direction including a leading and a trailing edge;

wherein:

(a) the first adjustable support means is constructed and arranged to allow the vacuum chamber to be positioned in a first position where the skimmer blade is out of contact with the adjacent forming fabric, and a second position where the skimmer blade can be in contact with the first forming fabric;

(b) the second adjustable resilient support means is constructed and arranged to allow movement of the skimmer blade when the vacuum chamber is in the second position to any point between a first locus where the fabric contacting surface of the skimmer blade is out of contact with the adjacent forming fabric, and a second locus where the fabric contacting surface of the skimmer blade is pressed into the machine side surface of the adjacent forming fabric;

(c) the vacuum chamber, together with the vacuum supply means, is constructed and arranged, when positioned in the second position, to capture into the elongate orifice at least a major proportion of any fluid skimmed off the adjacent moving forming fabric adjacent the leading edge of the fabric contacting surface of the skimmer blade; and (d) the skimmer blade contacts the machine side of one forming fabric at a point that is between two fixed support elements in contact with the machine side of the other forming fabric.

Preferably, when the skimmer blade mounting of this invention is incorporated into a twin fabric forming section, the two fixed support elements in contact with the machine side of the other forming fabric comprise at least a part of a forming shoe.

Preferably, the forming section includes at least one suction assisted fluid skimmer blade mounting. Alternatively, the forming section includes more than one suction assisted fluid skimmer blade mounting. Additionally, the forming section includes more than one suction assisted fluid skimmer blade mounting, at least one of which is located adjacent the machine sides of each of the two forming fabrics.

DETAILED DESCRIPTION OF THE INVENTION

The invention will now be described with reference to the embodiment shown in the attached schematic drawings in which.

Figure 1:
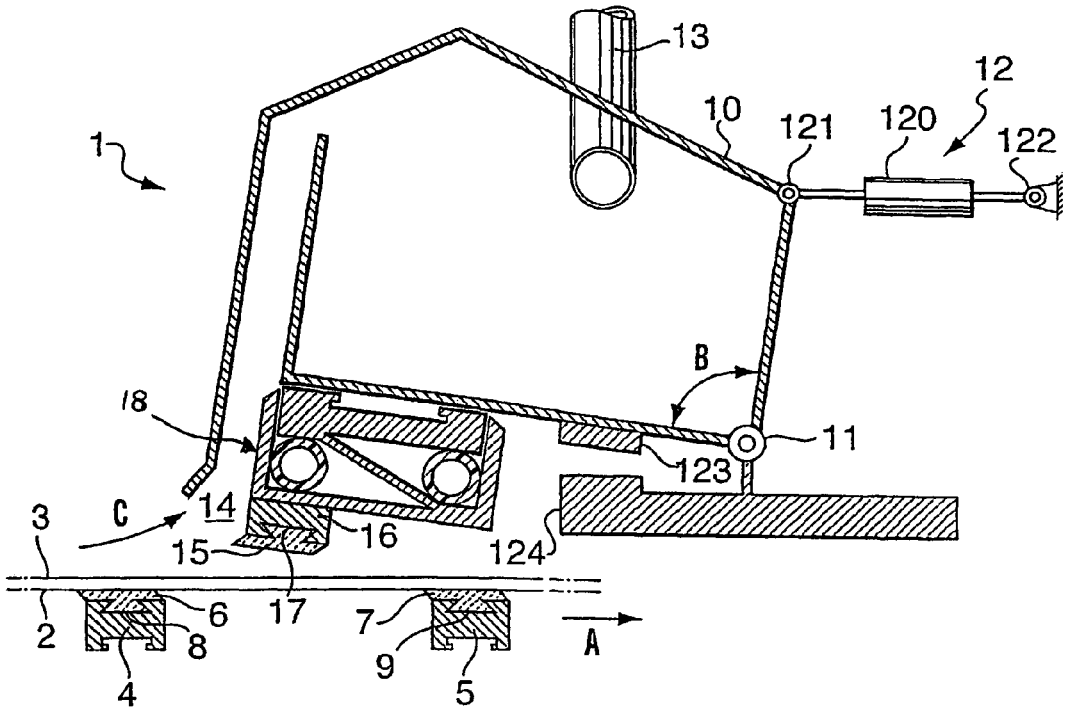
FIG. 1 shows schematically the general arrangement of a suction assisted fluid skimmer blade mounting in a forming section.

Referring first to FIG. 1, the forming section 1 includes two forming fabrics 2, 3 which move together through the forming section 1 in the direction shown by the arrow A. On the machine side of the forming fabric 2 support structures 4, 5 each carry a blade 6, 7 attached to the support structure by a conventional dovetail means 8, 9. In FIG. 1 only two blades are shown; a forming section of this type will generally include more than two such blades. The attachment shown for each of these blades is a conventional substantially rigid dovetail structure; other systems such as a T-bar are known and used. The only way the fabric contacting surface, and the orientation, of these blades can be altered is to remove and then replace them with a different blade.

The suction assisted fluid skimmer blade mounting of this invention is mounted on the other side of the two forming fabrics from the fixed blades 6, 7. The main part of the mounting is a vacuum drainage box 10. This is supported by a first support means 11. In the construction shown, the support means permits rotation of the vacuum drainage box through a small arc in the directions shown by the arrow B. The position of the vacuum drainage box is controlled by the control means 12, which is discussed further below.

A controlled level of vacuum is applied to the vacuum drainage box by the controlled vacuum means shown schematically at 13. Suitable devices for this purpose are well known. The level of vacuum required for the suction assisted fluid skimmer blade mounting of this invention is also discussed below. Fluid enters the vacuum drainage box through the orifice 14, which extends in the cross machine direction adjacent the skimmer blade 15. As shown, the skimmer blade attachment 16 includes a conventional dovetail arrangement 17. The skimmer blade 15, together with the attachment 16, is resiliently supported by a second support means shown schematically at 18. The construction of this support means is shown in more detail in FIG. 2. The vacuum drainage box is shown in FIG. 1 in its first position, at which the skimmer blade 15 is out of contact with the forming fabric 3.

Any suitable device can be used for the control means 12. A convenient one is a hydraulic cylinder 120, carried by suitable pivots as at 121 and 122. In most installations, more than one cylinder, each with its own pivots, will be required spread out in the cross machine direction. Hydraulic control systems for such a set of cylinders are well known. FIG. 1 shows the vacuum box located in its first position. The precise location for the first position is not important, provided that it brings the skimmer blade 15 out of contact with the forming fabric 3. The vacuum drainage box 10 is shown in its second position in FIG. 2. This position is controlled accurately by the cooperating stops 123, 124 attached respectively to the vacuum assisted drainage box and to a suitably rigid part of the forming section structure, such as a beam carrying the first support 11. At least one of these stops will be adjustable so that the second position for the drainage box 10 can be set accurately. The cooperating stops 123, 124 are set so that when the skimmer blade resilient mounting 18 is fully retracted, the skimmer blade 15 is just out of contact with the forming fabric 3. In order to provide adequate engagement of the skimmer blade 15 with the forming fabric 3 the resilient mounting 18 will generally provide a range of movement in the Z-direction with the drainage box in the second position of from about 5 mm to about 10 mm.

Figure 2:
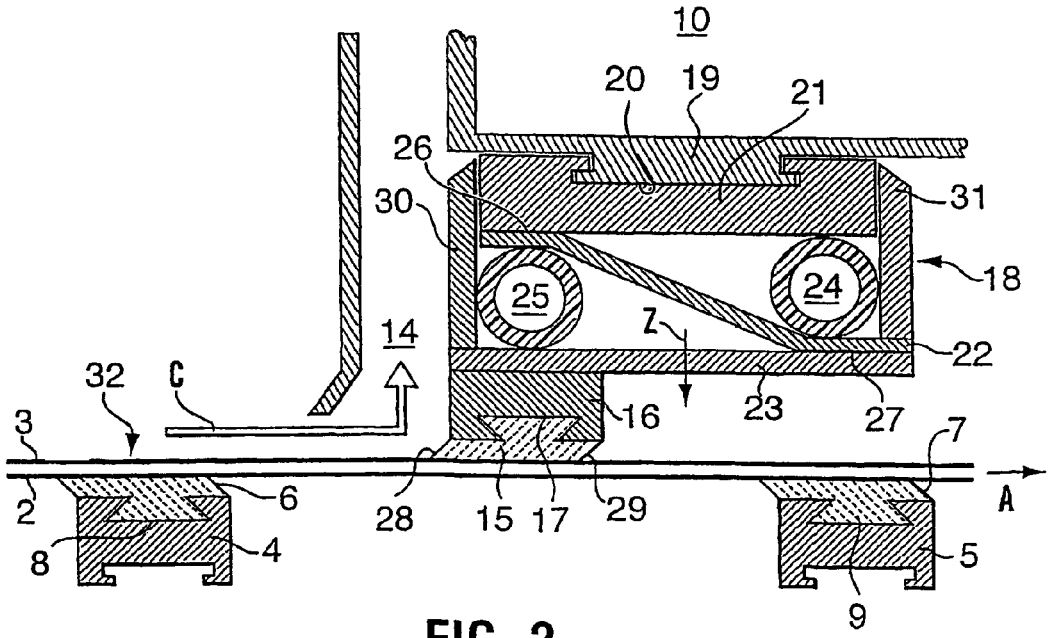
FIG. 2 shows in more detail the adjustable mounting of FIG. 1 with the skimmer blade in contact with a forming fabric.

Referring now to FIG. 2, the details of the preferred second adjustable resilient mounting 18 are shown. The mounting 18 is attached to the vacuum drainage box 10 by a conventional T-bar 19 mated into a corresponding slot 20 in the base 21 of the resilient mounting. The mounting proper comprises essentially four parts: two flexible members 22, and 23, and two hose members, 24 and 25. These four parts cooperate as follows when the mounting is activated to move the skimmer blade in the Z-direction. The two flexible members 22 and 23 are fabricated so that when there is no pressure in either of the hoses 24 and 25, the skimmer blade is close to, but not in contact with, the forming fabric 3 when the vacuum box is in its second position, as determined by the stops 123, 124. Application of pressure to the hoses 24 and 25 moves the skimmer blade in the Z-direction into contact with the forming fabric 3, by bending the flexible members 22 and 23. Since member 22 is secured at 26 to the upstream edge of the base member 21, and member 23 is secured to the downstream edge of the flexible member 22 at 27, even pressurization of the hoses 24 and 25 moves the skimmer blade 15 in a more or less straight line in the Z-direction, into contact with the forming fabric 3, with its face more or less parallel to the, surface of the forming fabric. By altering the pressures in the two hoses 24 and 25 the orientation of the skimmer blade 15 can be changed, so that either the leading edge 28, or the trailing edge 29, can be pressed into the forming fabric 3. Both the orientation of the blade 15, and the amount of indentation into the forming fabric 3, affect both the pressure pulses generated in the stock between the two forming fabrics and the amount of fluid skimmed from the machine side surface of the forming fabric.

The mounting 18 also includes two end plates 30 and 31. These serve both to minimise penetration of solids from the stock into the internal spaces between the hoses 24, 25 and the flexible members 22 and 23, and to guide the skimmer blade during movement of the mounting.

In FIGS. 1 and 2 a preferred flexible mounting is shown. This mounting does not involve any sliding or rotating parts which can become obstructed by accumulations of paper making solids. Other known mountings, such as some of those described by Bubik in U.S. Pat. No. 5,262,010, can also be used. As shown in FIG. 2 the mounting 18 utilizes separate parts for the base 21, the two flexible members 22, 23, and the end plates 30, 31. Depending upon the material chosen for these parts, either three parts as shown can be used, or the whole unit can be fabricated as a unitary construction. Where separate parts are used, any suitable means can be used to attach them together. These parts are conveniently fabricated from fibre reinforced plastic or stainless steel. Stainless steel is preferred.

In order to flex the mounting, pressure is applied to the hoses 24 and 25. It is preferred that hydraulic pressure, rather than air pressure, is used for this purpose. It is also necessary that the control system used for the hydraulic or air pressure includes a reservoir or the like, so that the mounting is resilient, and can move to accommodate transient changes in stock thickness. Pressure systems with this capability are well known for both air and hydraulic use. Since the skimmer blade, together with its resilient mounting, has some flexibility, it is able to respond to local stock thickness variations which only extend in the cross machine direction partway across the forming section. The resilient mounting also allows the skimmer blade to apply a more or less uniform pressure in the cross machine direction to the machine side surface of the forming fabric.

When the skimmer blade 16 is brought into contact with the forming fabric 3 it will doctor fluid off the machine side surface 32 of fabric 3. At least the major proportion of this fluid is captured into the elongate orifice 14 and travels in the direction shown generally by the arrow C. To ensure that this occurs, sufficient vacuum is applied by the controlled vacuum means 13 to the vacuum drainage box 10. Since the elongate orifice 14 is not in contact with the forming fabric, the level of applied vacuum in the vacuum assisted drainage can be controlled to capture at least a major proportion of the doctored off fluid without at the same time extracting fluid from the stock in between the forming fabrics 2 and 3.

With the skimmer blade in contact with a forming fabric, the nature of the pressure pulses generated within the stock by the skimmer blade are determined by how far the skimmer blade is moved in the Z-direction and indented into the machine side of the forming fabric, together with the orientation of the blade surface relative to the machine side surface path of the forming fabric at that point. The resilient mounting of the skimmer blade to the vacuum box allows the alteration of each of these variables without any interruption of production on the papermaking machine. A further level of control can be obtained by the use of more than one skimmer blade assembly, comprising a skimmer blade, its resilient mounting, and a vacuum box. Each assembly can be activated and deactivated as seen to be necessary to optimize paper making conditions in the forming section. When more than one skimmer blade assembly is used, these can be placed on either or both sides of the two forming fabrics. The or each resiliently mounted skimmer blade assembly will always be located between two fixed blades in contact with the machine side surface of the other forming fabric, for example between two blades supported by a forming shoe on the other side of the forming fabrics.

In the practice of this invention, it is contemplated that the surface of the skimmer blade will generally be flat. However, in certain circumstances, the use of a skimmer blade with a contoured profile may be found to be desirable.

It is thus apparent that, for any given twin fabric forming section, some experimentation will often be required to obtain the desired strength in the pressure pulses generated in the stock, and the amount of fluid doctored off the machine side of the forming fabric by the skimmer blade. Further, since the position of the skimmer blade in the Z-direction, and the orientation of the skimmer blade surface relative to the path of the machine side surface of the forming fabric at that point are independently adjustable, it becomes far easier to reconfigure the papermaking machine to accommodate a change in product being made.

What is claimed is:

1. A vacuum box and skimmer blade assembly for use in a twin fabric forming section of a paper making machine, the forming section including a first and a second forming fabric each having a machine direction and a cross-machine direction, and a machine side surface and a paper side surface, and being movable together in the machine direction through the forming section, the assembly including:

a vacuum chamber, having an elongate orifice extending in the cross-machine direction, to which a controlled vacuum means is connected;

a first adjustable support means supporting the vacuum chamber;

a second adjustable resilient support means carried by the vacuum chamber and adjacent the elongate orifice; and a skimmer blade attached to the second adjustable resilient support means, the skimmer blade having a fabric contacting surface extending in the cross-machine direction and including a leading and a trailing edge;

wherein:

(a) the first adjustable support means is constructed and arranged to allow the vacuum chamber to be positioned in a first chamber position where the skimmer blade is out of contact with the first forming fabric, and a second chamber position where the skimmer blade can be brought into contact with the forming fabric;

(b) the second adjustable resilient support means is constructed and arranged to allow adjustment to the position of the skimmer blade when the vacuum chamber is in the second chamber position to any point between a first blade position where the fabric contacting surface of the skimmer blade is out of contact with the first forming fabric, and a second blade position where the fabric contacting surface of the skimmer blade is in contact with the machine side surface of the first forming fabric; and (c) the vacuum chamber, together with the vacuum supply means, is constructed and arranged, when positioned in the second position, to capture into the elongate orifice at least a major proportion of any fluid skimmed off the first moving forming fabric adjacent the leading edge of the fabric contacting surface of the skimmer blade.

2. A vacuum box and skimmer blade assembly according to claim 1 wherein the second adjustable resilient support is constructed and arranged to provide for adjustment of the orientation of the skimmer blade relative to the machine side surface of the forming fabric to one of a plurality of preselected fabric contacting positions while in the second blade position.

3. A vacuum box and skimmer blade assembly according to claim 2 wherein the preselected fabric contacting positions are selected from the group consisting essentially of contact by and proximate to the leading edge of the skimmer blade surface, contact by and proximate to the trailing edge of the skimmer blade surface, and substantially equal contact over the entire fabric contacting surface between the leading edge and the trailing edge of the skimmer blade.

4. A vacuum box and skimmer blade assembly according to claim 1 wherein the second adjustable resilient support means comprises a flexible mounting means and flexion control means to urge the skimmer blade into the second blade position.

5. A vacuum box and skimmer blade assembly according to claim 4 wherein the flexion control means is a pressurized means.

6. A vacuum box and skimmer blade assembly according to claim 5 wherein the pressurized means is chosen from the group consisting of a hydraulic means and a pneumatic means.

7. A forming section for a paper making machine including a first and a second opposed forming fabric, each fabric having a machine direction and a cross-machine direction and a machine side surface and a paper side surface, including at least one vacuum box and skimmer blade assembly including:

a vacuum chamber, having an elongate orifice extending in the cross-machine direction, to which a controlled vacuum means is connected;

a first adjustable support means supporting the vacuum chamber;

a second adjustable resilient support means carried by the vacuum chamber and adjacent the elongate orifice; and a skimmer blade attached to the second adjustable resilient support means, the skimmer blade having a fabric contacting surface extending in the cross-machine direction including a leading and a trailing edge;

wherein:

(a) the first adjustable support means is constructed and arranged to allow the vacuum chamber to be positioned in a first position where the skimmer blade is out of contact with the adjacent forming fabric, and a second position where the skimmer blade can be brought into contact with the forming fabric;

(b) the second adjustable resilient support means is constructed and arranged to allow adjustment to the position of the skimmer blade when the vacuum chamber is in the second position to any point between a first blade position where the fabric contacting surface of the skimmer blade is out of contact with the adjacent forming fabric, and a second blade position where the fabric contacting surface of the skimmer blade is in contact with the machine side surface of the adjacent forming fabric;

(c) the vacuum chamber, together with the vacuum supply means, is constructed and arranged, when positioned in the second position, to capture into the elongate orifice at least a major proportion of any fluid skimmed off the adjacent moving forming fabric adjacent the leading edge of the fabric contacting surface of the skimmer blade; and (d) in the second blade position the skimmer blade contacts the machine side surface of one forming fabric at a point that is between two fixed support elements in contact with the machine side of the other forming fabric.

8. A forming section according to claim 7 wherein a forming shoe is provided proximate to the machine side surface of the second forming fabric and the or each assembly is located proximate to the machine side surface of the second forming fabric.

9. A forming section according to claim 7 wherein the forming section includes one assembly.

10. A forming section according to claim 7 wherein the forming section includes more than one assembly.

11. A forming section according to claim 10 wherein at least one assembly is located adjacent the machine side surfaces of each of the two forming fabrics.

* * * * *